US012007115B1

(12) United States Patent
Sen et al.

(10) Patent No.: US 12,007,115 B1
(45) Date of Patent: Jun. 11, 2024

(54) HIGH SHEAR SWIRLER FOR GAS TURBINE ENGINE

(71) Applicant: Raytheon Technologies Corporation, Farmington, CT (US)

(72) Inventors: Baris A. Sen, S. Glastonbury, CT (US); Zhongtao Dai, West Hartford, CT (US); Wookyung Kim, Glastonbury, CT (US); Stephen K. Kramer, Cromwell, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 18/115,111

(22) Filed: Feb. 28, 2023

(51) Int. Cl.
*F23R 3/14* (2006.01)

(52) U.S. Cl.
CPC ..... *F23R 3/14* (2013.01)

(58) Field of Classification Search
CPC ..... F23R 3/10; F23R 3/12; F23R 3/14
See application file for complete search history.

(56) References Cited

U.S. PATENT DOCUMENTS

| | | | | |
|---|---|---|---|---|
| 5,373,693 | A | 12/1994 | Zarzalis | |
| 6,244,051 | B1 | 6/2001 | Zarzalis | |
| 9,285,122 | B2 | 3/2016 | Jones | |
| 11,378,275 | B2 | 7/2022 | Locke | |
| 2003/0196440 | A1* | 10/2003 | Steinthorsson | F23D 11/107 60/776 |
| 2008/0178598 | A1* | 7/2008 | Commaret | F23R 3/14 60/748 |

* cited by examiner

*Primary Examiner* — Steven M Sutherland
(74) *Attorney, Agent, or Firm* — Getz Balich LLC

(57) ABSTRACT

A fuel injector assembly for a gas turbine engine includes a swirler and a fuel nozzle. The swirler has an outer wall having a SOW inner wall surface, an inner wall having a SIW inner wall surface and a SIW outer wall surface, an outer passage, and an inner passage. The SIW inner wall surface includes first and second sections. The first section extends between a first airflow inlet and the second section, and the second section extends between the first section and an inner wall distal end. The first section tapers radially inward, and the second section extends parallel the center axis. The outer wall circumscribes the inner wall and extends axially along the center axis to a distal outer wall end, and the distal end wall is axially recessed within the swirler from the distal outer wall end. The fuel nozzle projects into the inner passage.

8 Claims, 15 Drawing Sheets

HIGH SHEAR SWIRLER FOR GAS TURBINE ENGINE

1. TECHNICAL FIELD

This disclosure relates generally to a fuel injector assembly and, more particularly, to a fuel injector assembly with a high shear swirler.

2. BACKGROUND INFORMATION

Various types and configurations of fuel injector assemblies are known in the art. Some of these known fuel injector assemblies include a high shear swirler mated with a fuel injector nozzle. While these known fuel injector assemblies have various advantages, there is still room in the art for improvement. In particular, there is still room in the art for fuel injector assemblies capable of improving fuel-air mixing, reducing combustor dynamics and/or reducing undesirable combustor tones.

SUMMARY

According to an aspect of the present disclosure, a fuel injector assembly for a gas turbine engine is provided that includes a swirler and a fuel nozzle. The swirler is configured with an outer wall having a swirler outer wall (SOW) inner wall surface, and an inner wall having a swirler inner wall (SIW) inner wall surface and a SIW outer wall surface, an outer passage defined at least in part by the SIW outer wall surface and the SOW inner wall surface, and an inner passage defined in part by the SIW inner wall surface. The outer wall and the inner wall have a center axis. The SIW inner wall surface includes a first section and a second section. The first section extends between a first airflow inlet and the second section, and the second section extends between the first section and a distal end wall of the inner wall. The first section tapers radially inward toward the center axis in a conical configuration at a first angle relative to the center axis. The second section extends at a second angle relative to the center axis. The first angle is different than the second angle. The outer wall circumscribes the inner wall and extends axially along the center axis to a distal outer wall end. The distal end wall of the inner wall is axially recessed within the swirler from the distal outer wall end. The fuel nozzle projects into the inner passage.

In any of the aspects or embodiments described above and herein, the SOW inner wall surface may taper radially inward toward the center axis in a conical configuration.

In any of the aspects or embodiments described above and herein, at least a portion of the SOW inner wall surface may be parallel at least a portion of the SIW outer wall surface.

In any of the aspects or embodiments described above and herein, the distal outer wall end may be disposed a first distance along the axis from a tip of the fuel nozzle, and the distal outer wall end may be disposed a second distance along the axis from the distal inner wall end, and the outer passage has a diameter at the distal outer wall end, and a first value is equal to the first distance minus the second distance, and wherein a quotient of the first value divided by the diameter is less than one.

In any of the aspects or embodiments described above and herein, the second section may extend parallel the center axis.

In any of the aspects or embodiments described above and herein, the second angle may be less than the first angle.

In any of the aspects or embodiments described above and herein, the second section may taper radially inward toward the center axis in a conical configuration at the second angle relative to the center axis.

In any of the aspects or embodiments described above and herein, the second section may taper radially away from the center axis.

In any of the aspects or embodiments described above and herein, the second section may be disposed at an angle beta relative to the center axis, wherein the angle beta is in the range of greater than zero degrees and an angle at which a line contiguous with the second section is tangential to an inner edge of the distal outer wall end.

In any of the aspects or embodiments described above and herein, the second section may be conically configured.

In any of the aspects or embodiments described above and herein, an intersection between the first section and the second section may be a sharp transition or a smoothed transition.

According to an aspect of the present disclosure, a fuel injector assembly for a gas turbine engine is provided that includes a swirler and a fuel nozzle. The swirler is configured with an outer wall having a swirler outer wall (SOW) inner wall surface, and an inner wall having a swirler inner wall (SIW) inner wall surface and a SIW outer wall surface, an outer passage defined at least in part by the SIW outer wall surface and the SOW inner wall surface, and an inner passage defined in part by the SIW inner wall surface. The outer wall and the inner wall have a center axis. The SOW outer wall surface includes a first section and a second section. The first section extends between a first airflow inlet and the second section, and the second section extends between the first section and a distal end wall of the outer wall. The first section arcuately tapers radially inward toward the center axis, and the second section arcuately tapers radially away from the center axis. The outer wall circumscribes the inner wall and extends axially along the center axis to a distal outer wall end, and the distal end wall of the inner wall is axially recessed within the swirler from the distal outer wall end. The fuel nozzle projects into the inner passage.

In any of the aspects or embodiments described above and herein, the first section and the second section may intersect at an inflection point where the arcuate inward radial taper of the first section transitions to the arcuate outward radial taper of the second section.

In any of the aspects or embodiments described above and herein, the SIW outer wall surface may be arcuately shaped, and the SIW outer wall surface and the SOW inner wall surface may define an arcuately shaped outer passage.

In any of the aspects or embodiments described above and herein, the SIW outer wall surface and the SOW inner wall surface may extend at a constant distance relative to one another for a length of the outer passage.

The foregoing features and elements may be combined in various combinations without exclusivity, unless expressly indicated otherwise. For example, aspects and/or embodiments of the present disclosure may include any one or more of the individual features or elements disclosed above and/or below alone or in any combination thereof. These features and elements as well as the operation thereof will become more apparent in light of the following description and the accompanying drawings. It should be understood, however, the following description and drawings are intended to be exemplary in nature and non-limiting.

DETAILED DESCRIPTION

Figure 1:
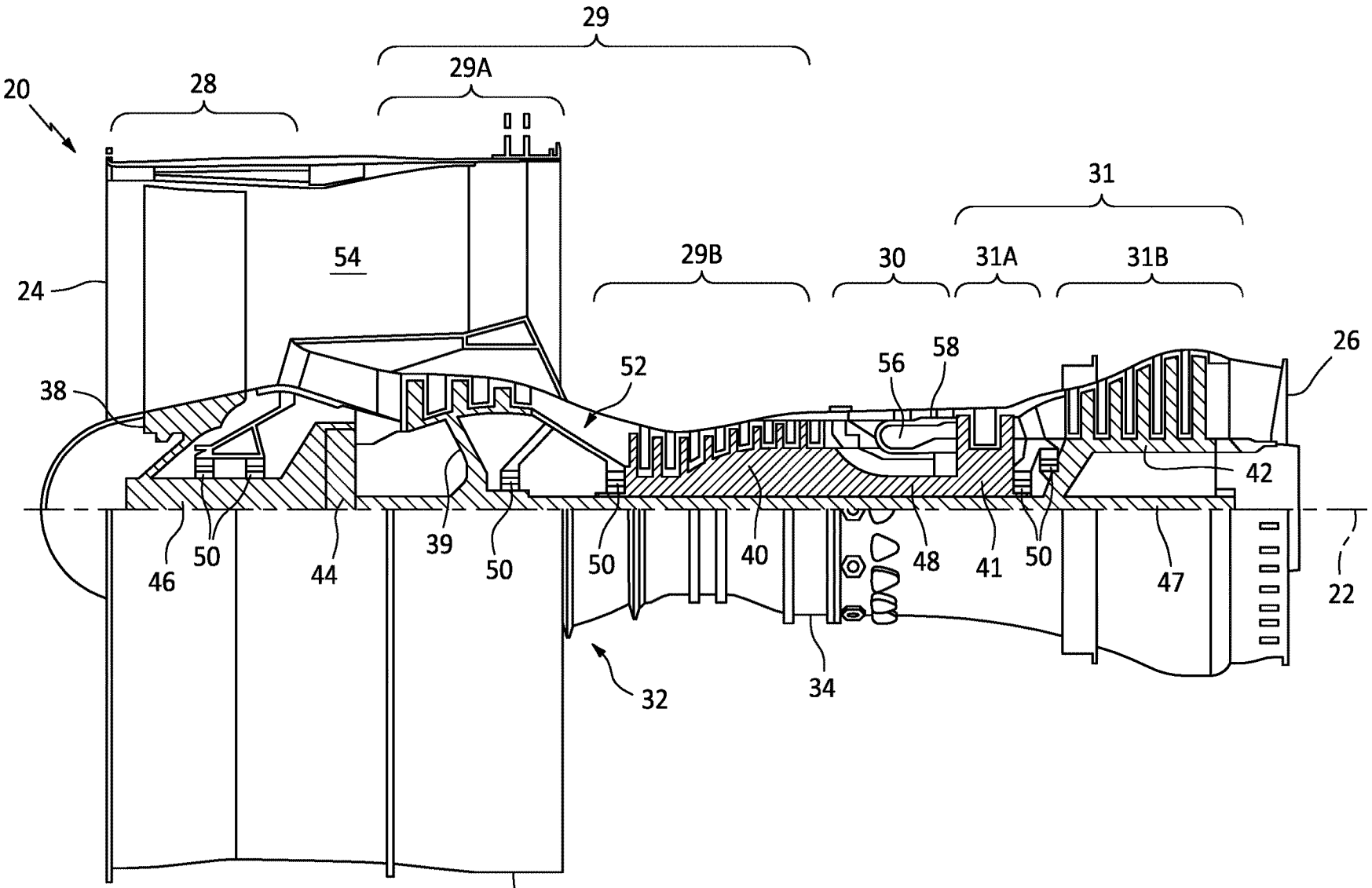
FIG. 1 is a side cutaway diagrammatic illustration of a geared turbine engine.

FIG. 1 is a side cutaway illustration of a geared turbine engine 20. This turbine engine 20 extends along an axial centerline 22 between an upstream airflow inlet 24 and a downstream airflow exhaust 26. The turbine engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B.

The engine sections 28, 29A, 29B, 30, 31A and 31B are arranged sequentially along the centerline 22 within an engine housing 32. This housing 32 includes an inner case 34 (e.g., a core case) and an outer case 36 (e.g., a fan case). The inner case 34 may house one or more of the engine sections 29A-31B; e.g., an engine core. The outer case 36 may house at least the fan section 28.

Each of the engine sections 28, 29A, 29B, 31A and 31B includes a respective rotor 38-42. Each of these rotors 38-42 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 38 is connected to a gear train 44, for example, through a fan shaft 46. The gear train 44 and the LPC rotor 39 are connected to and driven by the LPT rotor 42 through a low speed shaft 47. The HPC rotor 40 is connected to and driven by the HPT rotor 41 through a high speed shaft 48. The shafts 46-48 are rotatably supported by a plurality of bearings 50; e.g., rolling element and/or thrust bearings. Each of these bearings 50 is connected to the engine housing 32 by at least one stationary structure such as, for example, an annular support strut.

During operation, air enters the turbine engine 20 through the airflow inlet 24. This air is directed through the fan section 28 and into a core gas path 52 and a bypass gas path 54. The core gas path 52 extends sequentially through the engine sections 29A-31B. The air within the core gas path 52 may be referred to as "core air". The bypass gas path 54 extends through a bypass duct, which bypasses the engine core. The air within the bypass gas path 54 may be referred to as "bypass air".

The core air is compressed by the compressor rotors 39 and 40 and directed into an annular combustion chamber 56 of a combustor 58 in the combustor section 30. Fuel is injected into the combustion chamber 56 and mixed with the compressed core air to provide a fuel-air mixture. This fuel air mixture is ignited and combustion products thereof flow through and sequentially cause the turbine rotors 41 and 42 to rotate. The rotation of the turbine rotors 41 and 42 respectively drive rotation of the compressor rotors 40 and 39 and, thus, compression of the air received from a core airflow inlet. The rotation of the turbine rotor 42 also drives rotation of the fan rotor 38, which propels bypass air through and out of the bypass gas path 54. The propulsion of the bypass air may account for a majority of thrust generated by the turbine engine 20, e.g., more than seventy-five percent (75%) of engine thrust. The turbine engine 20 of the present disclosure, however, is not limited to the foregoing exemplary thrust ratio.

Figure 2:
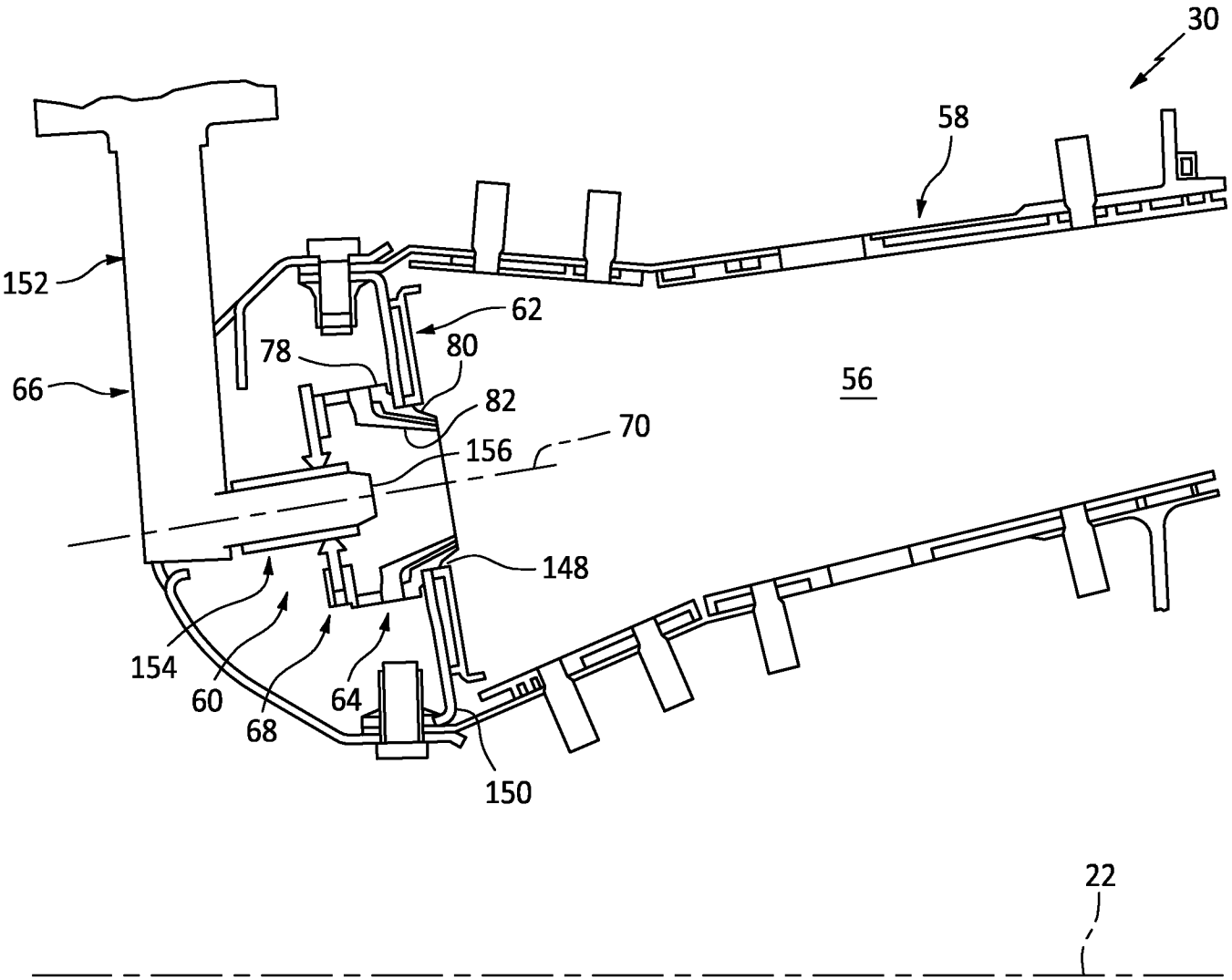
FIG. 2 is a partial side sectional diagrammatic illustration of a combustor section.

Referring to FIG. 2, the combustor section 30 includes a plurality of fuel injector assemblies 60 (one visible in FIG. 2) arranged circumferentially about the centerline 22 in an annular array. The fuel injector assemblies 60 are mounted to an annular bulkhead 62 of the combustor 58. The fuel injector assemblies 60 are configured to direct a mixture of fuel and compressed air into the combustion chamber 56 for combustion.

Each fuel injector assembly 60 includes a high shear swirler 64 and a fuel injector 66. The fuel injector assembly 60 of FIG. 2 also includes a mount 68 configured to couple the fuel injector 66 to the swirler 64.

Figure 3:
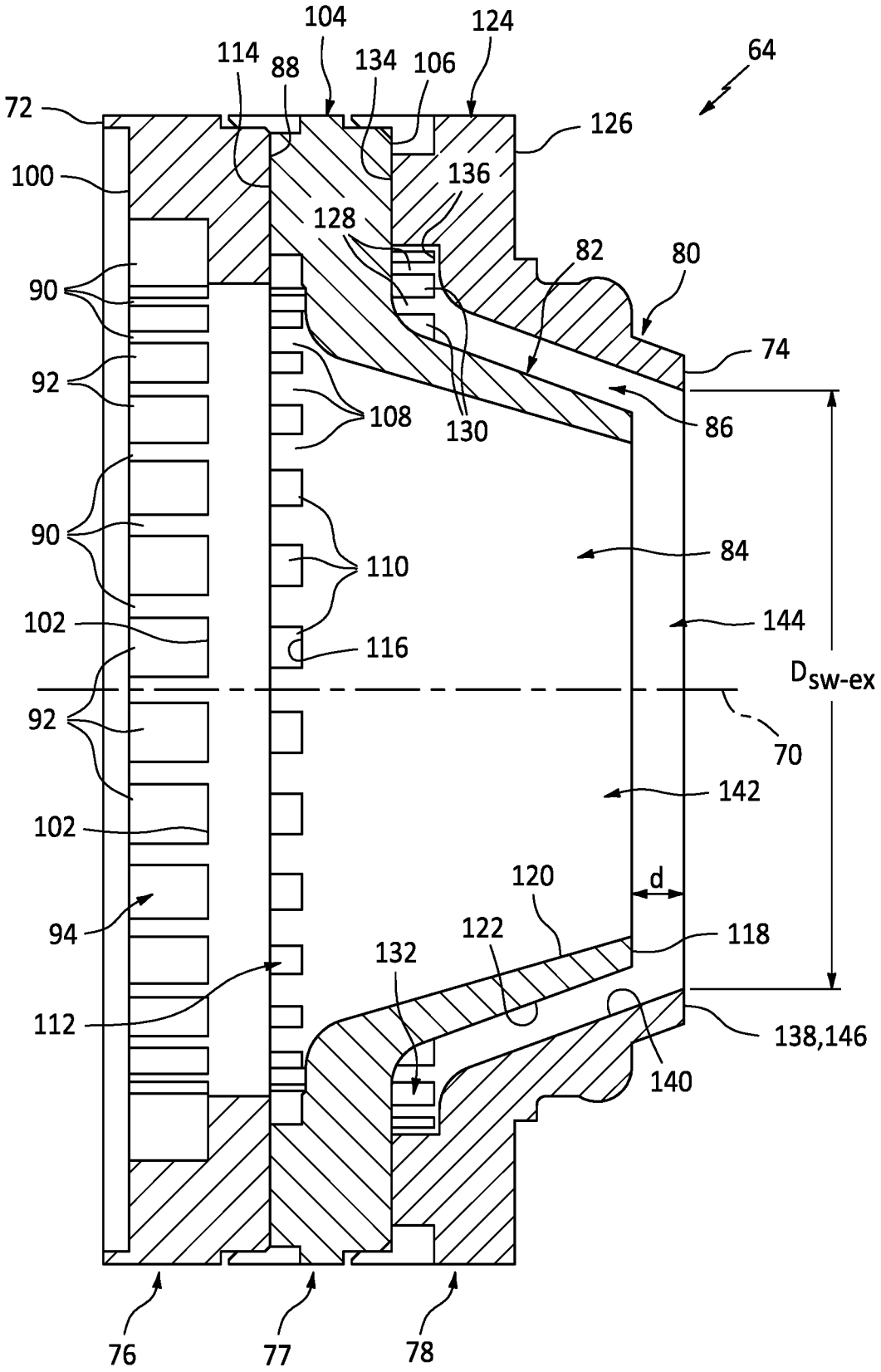
FIG. 3 is a side sectional diagrammatic illustration of a swirler embodiment.

Referring to FIG. 3, the swirler 64 extends circumferentially around an axis 70 (e.g., a centerline of the swirler 64) thereby providing the swirler 64 with a full hoop body. The swirler 64 extends axially along the axis 70 between a swirler upstream end 72 and a swirler downstream end 74.

The swirler 64 of FIG. 3 includes an upstream swirler segment 76, a flanged intermediate swirler segment 77 and a flanged downstream swirler segment 78. These swirler segments 76-78 configure the swirler 64 with a tubular swirler outer wall 80, a tubular swirler inner wall 82 (e.g., a fuel Filmer) and a plurality of swirler passages 84 and 86.

Figure 4A:
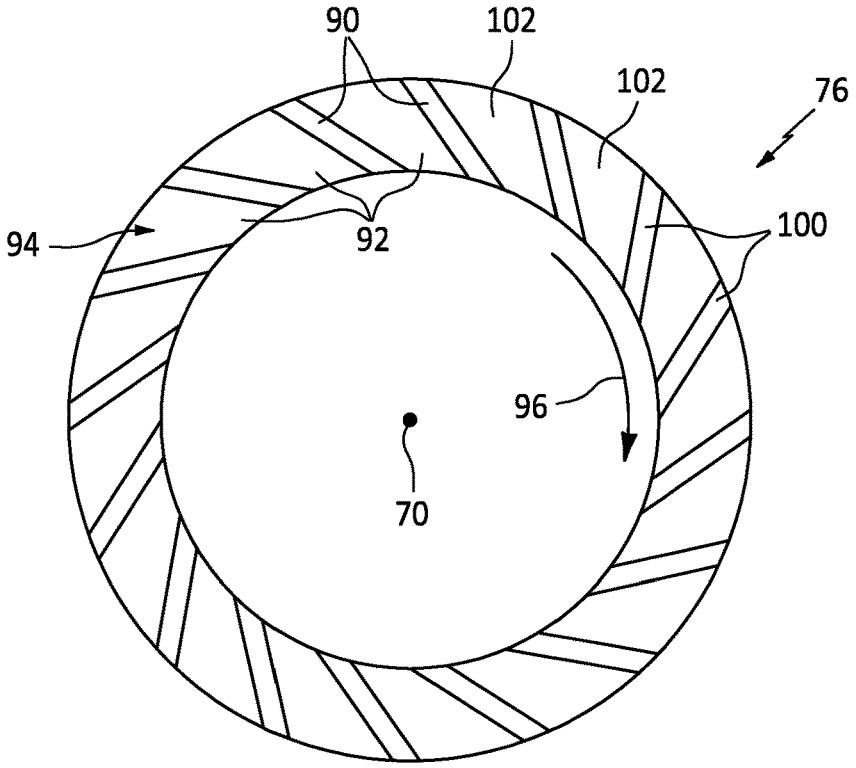
FIG. 4A is an end view diagrammatic illustration of an upstream swirler segment of the swirler with vanes arranged in a first circumferential direction.
Figure 4B:
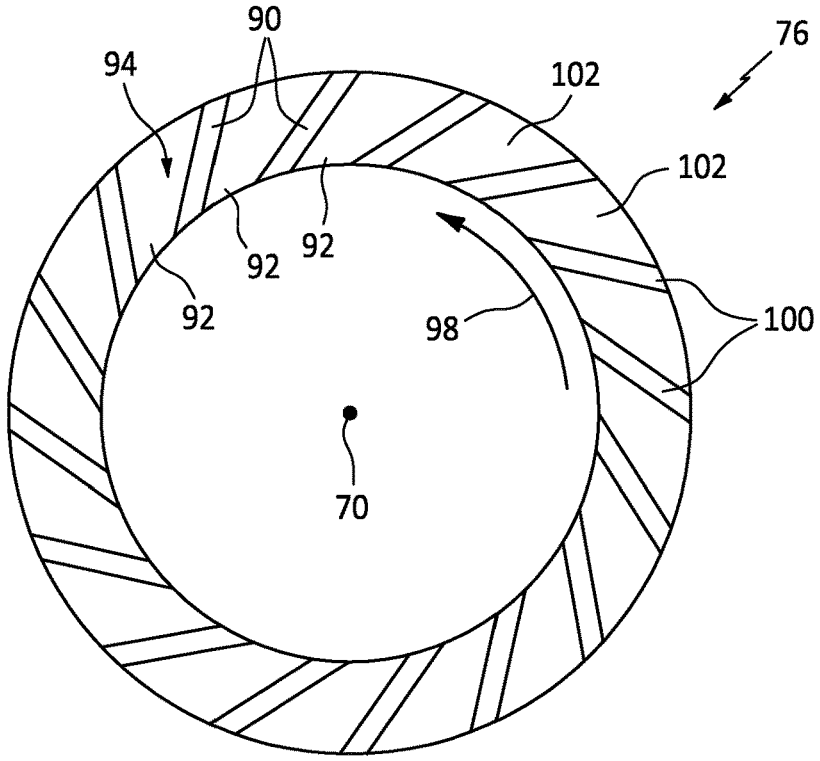
FIG. 4B is an end view diagrammatic illustration of the upstream swirler segment with the vanes arranged in a second circumferential direction.

The upstream swirler segment 76 extends circumferentially around the axis 70. The upstream swirler segment 76 is located at (e.g., on, adjacent or proximate) the swirler upstream end 72. The upstream swirler segment 76 of FIG. 3, for example, extends axially along the axis 70 from the swirler upstream end 72 to an annular upstream swirler segment surface 88. Referring to FIG. 4A, the upstream swirler segment 76 is configured with an upstream set of vanes 90. These upstream vanes 90 are arranged circumferentially around the axis 70 in an annular array. Each upstream vane 90 is circumferentially separated from each circumferentially adjacent (e.g., neighboring) upstream vane 90 by a respective air gap 92. The gaps 92 collectively form an upstream airflow inlet 94 into the swirler 64 at the swirler upstream end 72; see also FIG. 3. The upstream vanes 90 may be configured such that air entering the swirler 64 through the upstream airflow inlet 94 generally flows in a first circumferential direction 96 (e.g., a clockwise direction) about the axis 70. Alternatively, referring to FIG. 4B, the upstream vanes 90 may be configured such that air entering the swirler 64 through the upstream airflow inlet 94 generally flows in a second circumferential direction 98 (e.g., a counterclockwise direction) about the axis 70.

In the specific embodiment of FIG. 3, the upstream vanes 90 are arranged at the swirler upstream end 72. With this arrangement, each gap 92 may extend partially axially into the upstream swirler segment 76 from a castellated surface 100 of the segment 76 at the swirler upstream end 72 to a gap end surface 102. Of course, in other embodiments, each gap 92 may be formed completely axially within the swirler 64 and, for example, its upstream swirler segment 76.

The intermediate swirler segment 77 includes an annular intermediate swirler segment base 104 (e.g., a radial flange) and the swirler inner wall 82. The intermediate swirler segment 77 and each of its components 82 and 104 extends circumferentially around the axis 70.

The intermediate swirler segment base 104 is abutted axially against the upstream swirler segment 76. The intermediate swirler segment base 104, for example, may be coupled (e.g., bonded to) the upstream swirler segment surface 88. The intermediate swirler segment base 104 extends axially along the axis 70 from the upstream swirler segment 76 to an annular intermediate swirler segment surface 106.

Figure 5A:
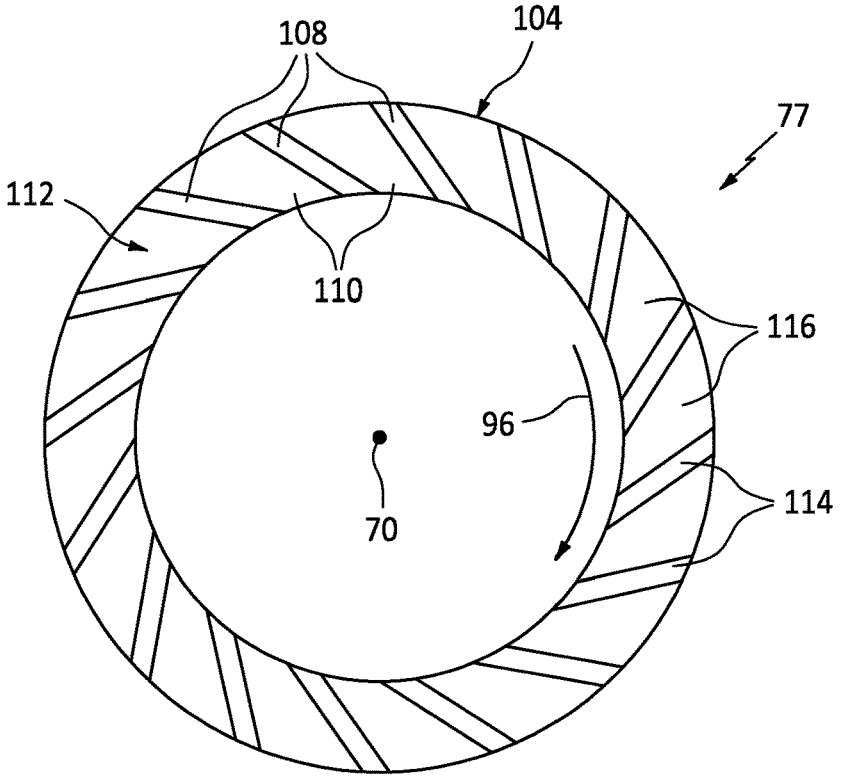
FIG. 5A is an end view diagrammatic illustration of an intermediate swirler segment of the swirler with vanes arranged in the first circumferential direction.
Figure 5B:
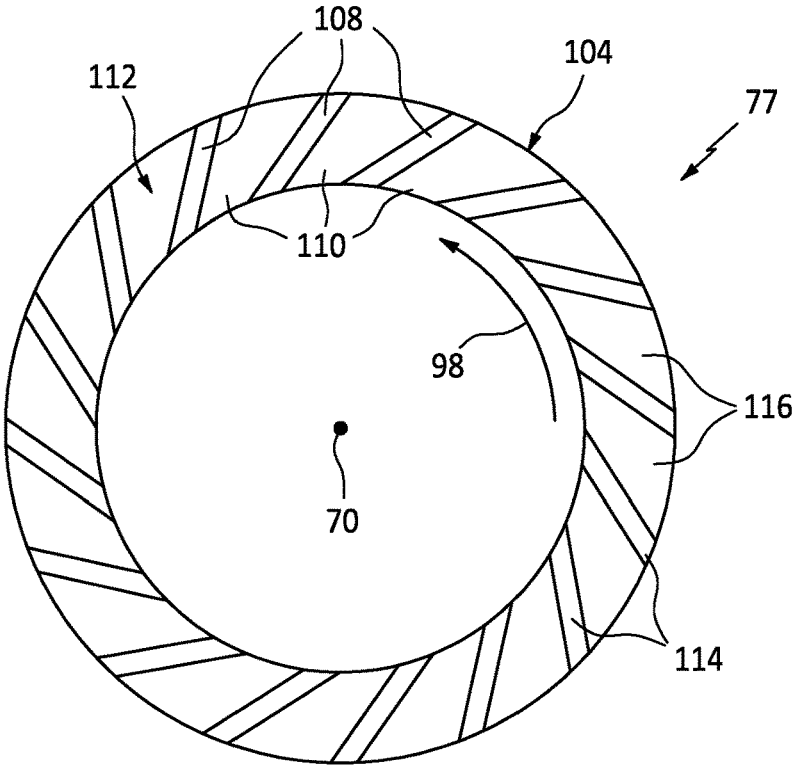
FIG. 5B is an end view diagrammatic illustration of the intermediate swirler segment with the vanes arranged in the second circumferential direction.

Referring to FIG. 5A, the intermediate swirler segment base 104 is configured with an intermediate set of vanes 108. These intermediate vanes 108 are arranged circumferentially around the axis 70 in an annular array. Each intermediate vane 108 is circumferentially separated from each circumferentially adjacent (e.g., neighboring) intermediate vane 108 by a respective gap 110. The gaps 110 collectively form an intermediate airflow inlet 112 into the swirler 64; see also FIG. 3. The intermediate vanes 108 may be configured such that air entering the swirler 64 through the intermediate airflow inlet 112 generally flows in the first circumferential direction 96 (e.g., the clockwise direction) about the axis 70. Alternatively, referring to FIG. 5B, the intermediate vanes 108 may be configured such that air entering the swirler 64 through the intermediate airflow inlet 112 generally flows in the second circumferential direction 98 (e.g., the counterclockwise direction) about the axis 70. This circumferential direction for the intermediate vanes 108 may be the same as the circumferential direction for the upstream vanes 90. However, in other embodiments, the circumferential direction for the intermediate vanes 108 may be the opposite as the circumferential direction for the upstream vanes 90.

In the specific embodiment of FIG. 3, the intermediate vanes 108 are arranged at a joint between the swirler segments 76 and 77. With this arrangement, each gap 110 may extend partially axially into the intermediate swirler segment 77 from a castellated surface 114 of the segment at the to a gap end surface 116. Of course, in other embodiments, each gap may be formed completely axially within the swirler 64 and, for example, its intermediate swirler segment 77.

The swirler inner wall 82 projects out from the intermediate swirler segment base 104 and extends axially (in a downstream direction along the axis 70) to an annular distal inner wall end 118. As the swirler inner wall 82 extends towards the distal inner wall end 118, the swirler inner wall 82 may (e.g., smoothly and/or continuously) radially taper inwards towards the axis 70. The swirler inner wall 82 may thereby have a tubular conical geometry with tubular conical inner and outer wall surfaces 120 and 122. The swirler inner wall 82 and its distal end 118 are each disposed radially with and axially overlapped by the swirler outer wall 80.

The downstream swirler segment 78 includes an annular downstream swirler segment base 124 (e.g., a radial flange) and the swirler outer wall 80. The downstream swirler segment 78 and each of its components 80 and 124 extends circumferentially around the axis 70. The downstream swirler segment base 124 is abutted axially against the intermediate swirler segment 77. The downstream swirler segment base 124, for example, may be coupled (e.g., bonded to) the intermediate swirler segment surface 106. The downstream swirler segment base 124 extends axially along the axis 70 from the intermediate swirler segment 77 to an annular downstream swirler segment surface 126.

Figure 6A:
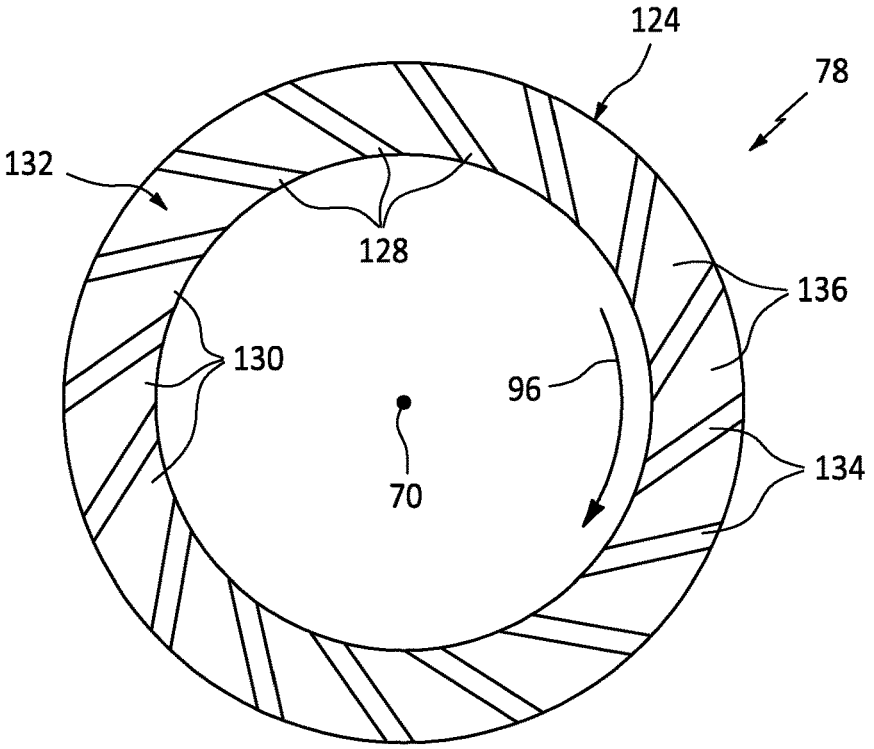
FIG. 6A is an end view diagrammatic illustration of a downstream swirler segment of the swirler with vanes arranged in the first circumferential direction.
Figure 6B:
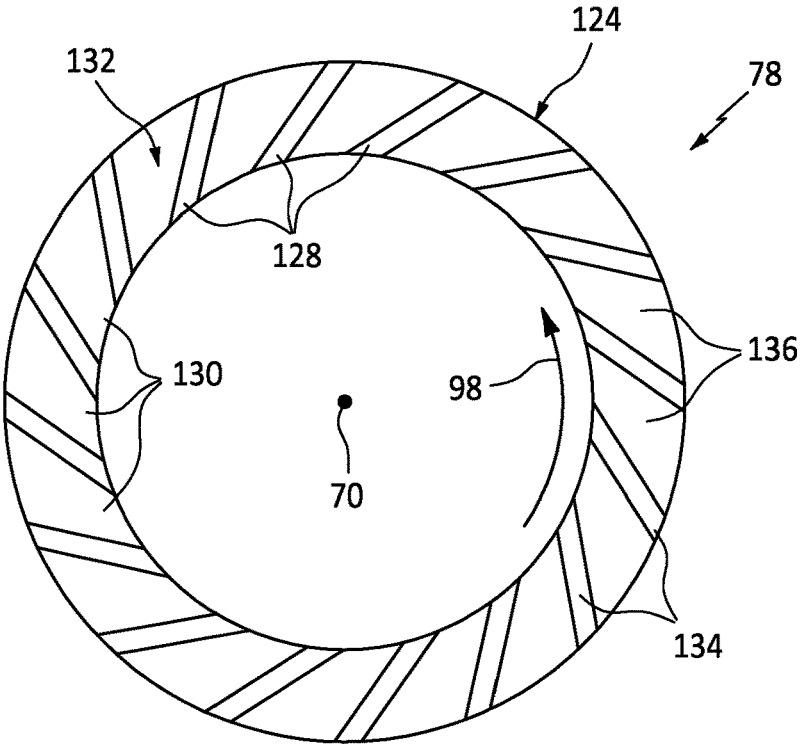
FIG. 6B is an end view diagrammatic illustration of the downstream swirler segment with the vanes arranged in the second circumferential direction.

Referring to FIG. 6A, the downstream swirler segment base 124 is configured with a downstream set of vanes 128. These downstream vanes 128 are arranged circumferentially around the axis 70 in an annular array. Each downstream vane 128 is circumferentially separated from each circumferentially adjacent (e.g., neighboring) downstream vane 128 by a respective gap 130. The gaps 130 collectively form a downstream airflow inlet 132 into the swirler 64; see also FIG. 3. The downstream vanes 128 may be configured such that air entering the swirler 64 through the downstream airflow inlet 132 generally flow in the first circumferential direction 96 (e.g., the clockwise direction) about the axis 70. Alternatively, referring to FIG. 6B, the downstream vanes 128 may be configured such that air entering the swirler 64 through the downstream airflow inlet 132 generally flows in the second circumferential direction 98 (e.g., the counterclockwise direction) about the axis 70. This circumferential direction for the downstream vanes 128 may be the same as the circumferential direction for the upstream vanes 90 and/or the intermediate vanes 108. However, in other embodiments, the circumferential direction for the downstream vanes 128 may be the opposite as the circumferential direction for the upstream vanes 90 and/or the intermediate vanes 108.

In the specific embodiment of FIG. 3, the downstream vanes 128 are arranged at a joint between the swirler segments 77 and 78. With this arrangement, each gap 130 may extend partially axially into the downstream swirler segment 78 from a castellated surface 134 of the segment at the to a gap end surface 136. Of course, in other embodiments, each gap 130 may be formed completely axially within the swirler 64 and, for example, its downstream swirler segment 78.

The swirler outer wall 80 projects out from the downstream swirler segment base 124 and extends axially (in the downstream direction along the axis 70) to an annular distal outer wall end 138. As the swirler outer wall 80 extends towards the distal outer wall end 138, the swirler outer wall 80 may (e.g., smoothly and/or continuously) radially taper inwards towards the axis 70. The swirler outer wall 80 may thereby have a generally tubular conical geometry with a tubular conical inner wall surface 140. The swirler outer wall 80 axially overlaps and circumscribes the swirler outer wall 80.

The swirler 64 is configured such that the distal inner wall end 118 and the distal outer wall end 138 are axially offset from one another along the axis 70. The distal inner wall end 118 of FIG. 3, for example, is axially recessed into the swirler 64 from the distal outer wall end 138. More particularly, the distal inner wall end 118 is disposed an axial distance (d) upstream of the distal outer wall end 138. The distal outer wall end 138 may thereby define a downstream most surface of the swirler 64; e.g., a dump plane of the swirler 64.

The inner passage 84 of FIG. 3 is an inner bore of the swirler 64. This inner passage 84 is formed radially within and by each of the swirler segments 76 and 77. The inner passage 84 is fluidly coupled with the upstream airflow inlet 94 and the intermediate airflow inlet 112. The inner passage 84 of FIG. 3 extends from the airflow inlets 94 and 112 to an inner nozzle outlet 142. This inner nozzle outlet 142 is defined by and radially within the swirler inner wall 82 at the distal inner wall end 118.

The outer passage 86 of FIG. 3 is an annular passage formed by the swirler segments 77 and 78. This outer passage 86 is formed radially between the swirler inner wall 82 and the swirler outer wall 80. The outer passage 86 is fluidly coupled with the downstream airflow inlet 132. The outer passage 86 of FIG. 3 extends from the downstream airflow inlet 132 to an outer nozzle outlet 144. This outer nozzle outlet 144 is defined by and radially between the swirler inner and outer walls 82 and 80 at their distal ends 118 and 138.

The outer passage 86 and its nozzle outlet 144 are configured with an inner diameter ($D_{sw\text{-}ex}$) at the distal outer wall end 138. This diameter ($D_{sw\text{-}ex}$) is measured from, for example, the inner wall surface 140 of the swirler outer wall 80 on a corner between that surface 140 and an annular distal outer wall end surface 146.

Referring to FIG. 2, the swirler 64 is mated with the bulkhead 62. In particular, the swirler inner and outer walls 82 and 80 project axially into or through a respective aperture 148 in the bulkhead 62. The swirler 64 is mounted to the bulkhead 62. The downstream swirler segment 78, for example, may be bonded (e.g., brazed or welded) and/or otherwise connected to the bulkhead 62 and, for example, a shell 150 of the bulkhead 62.

The fuel injector 66 includes a fuel injector stem 152 and a fuel injector nozzle 154. The fuel injector stem 152 is configured to support and route fuel to the fuel injector nozzle 154. The fuel injector nozzle 154 is cantilevered from the fuel injector stem 152, and projects along the axis 70 partially into the inner bore of the swirler 64. A tip 156 of the fuel injector nozzle 154 is thereby disposed within the inner passage 84.

Figure 7:
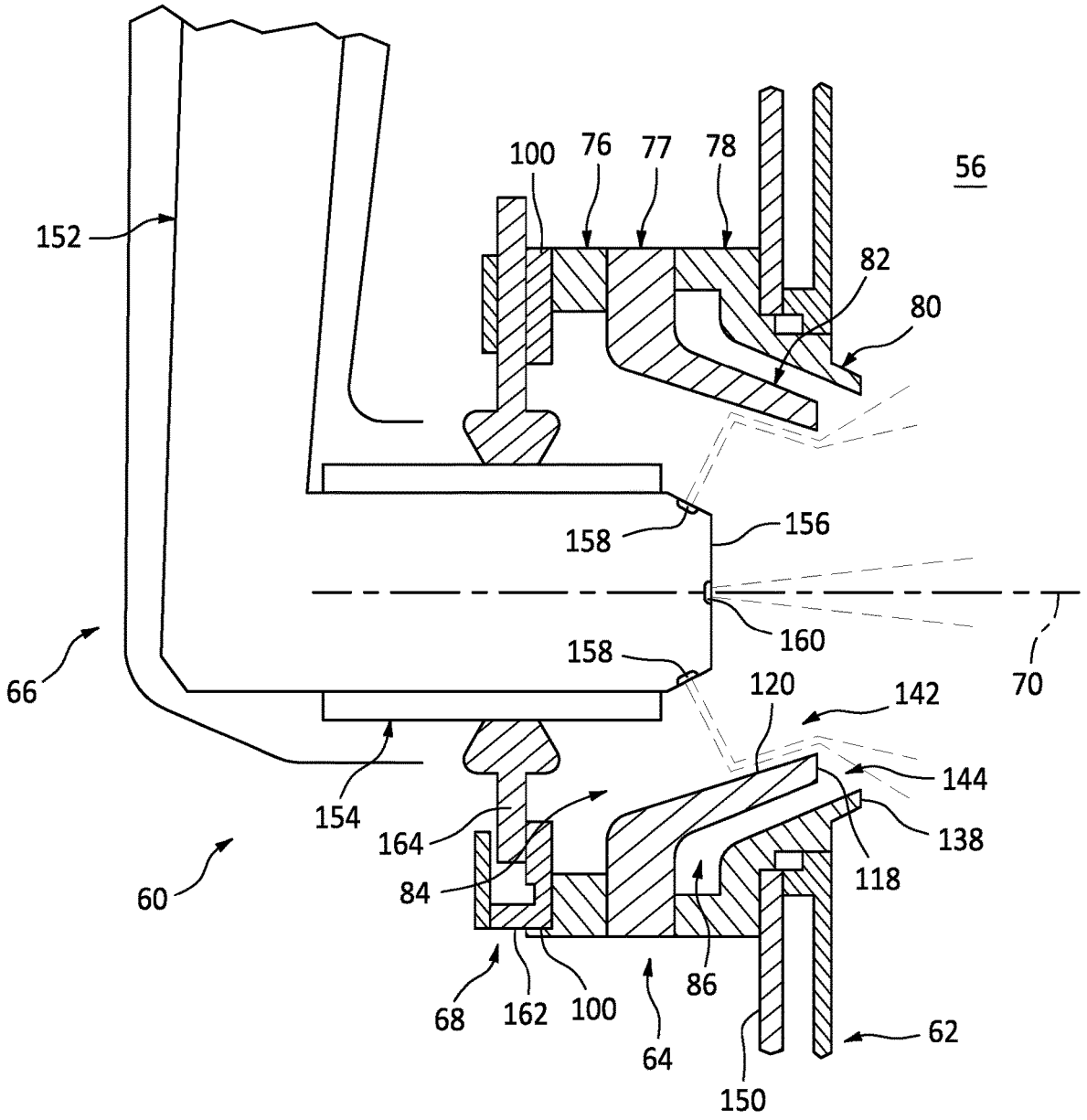
FIG. 7 is a partial side sectional diagrammatic illustration of the swirler mated with a fuel nozzle and a combustor bulkhead.
Figure 8:
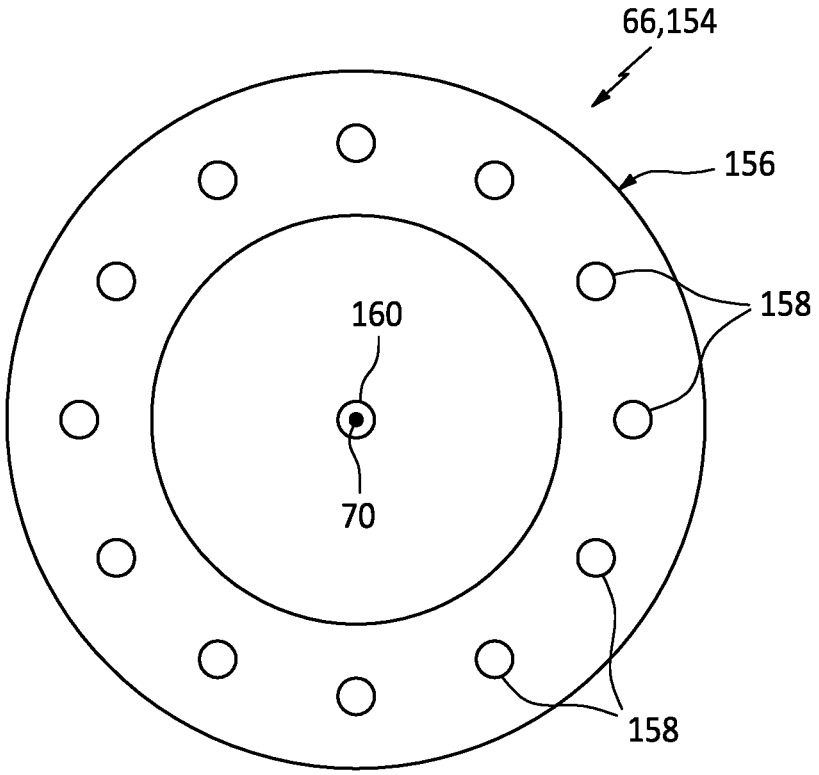
FIG. 8 is an end view diagrammatic illustration of a tip of the fuel nozzle.

Referring to FIG. 7, the fuel injector nozzle 154 includes a plurality of nozzle orifices 158 arranged circumferentially about the axis 70 in an annular array; see also FIG. 8. These nozzle orifices 158 may be axially aligned with (e.g., axially overlapped by) the swirler inner wall 82 and its inner wall surface 120. One or more or each of these nozzle orifices 158 is configured to direct a jet of fuel to impinge against the swirler inner wall 82 and its inner wall surface 120.

The fuel injector nozzle 154 may also include a central nozzle orifice 160; see also FIG. 8. This central nozzle orifice 160 may be coaxial with the axis 70 and thereby centrally located between the nozzle orifices 158. The central nozzle orifice 160 is configured to direct a jet of fuel along the axis 70, through the inner nozzle outlet 142, and into the combustion chamber 56. A quantity of fuel provided by this central nozzle orifice 160 may be less than a collective quantity of fuel provided by the nozzle orifices 158; however, the present disclosure is not limited to such a relationship.

The mount 68 is configured to couple the fuel injector nozzle 154 to the swirler 64. The mount 68 of FIG. 7, for example, includes a mount base 162 and a nozzle guide plate 164. The mount base 162 is connected (e.g., bonded) to the upstream swirler segment 76 and, for example, to its castellated surface 100. The mount base 162 is configured to capture the nozzle guide plate 164 in such a fashion that the nozzle guide plate 164 may float, to a limited degree, relative to the swirler 64. The nozzle guide plate 164 in turn is mated with the fuel injector nozzle 154. The fuel injector nozzle 154, for example, projects through a bore in the nozzle guide plate 164. The bore is sized such that the fuel injector nozzle 154 may slide axially along the axis 70 relative to the nozzle guide plate 164. The mount 68 thereby may (e.g., loosely) couple and locate the fuel injector nozzle 154 to the swirler while enabling for slight shifts due to differential thermal expansion as well as vibrations.

During operation of the fuel injector assembly 60 of FIG. 7, the nozzle orifices 158 direct the jets of fuel to impinge against the swirler inner wall 82. Upon hitting the inner wall surface 120, the swirling air introduced into the inner passage 84 form the airflow inlets 94 and 112 (see FIG. 3) may cause the fuel from the jets to form a thin film of fuel on the inner wall surface 120. This film of fuel travels along the inner wall surface 120 towards the inner nozzle outlet 142. At the inner nozzle outlet 142, the film of fuel separates from the swirler inner wall 82 and is acted upon by swirling air exiting both the inner nozzle outlet 142 and the outer nozzle outlet 144. The air may exit the nozzle outlets 142 and 144 at different speeds and thereby subject the separated fuel to a shear force. This shear force may cause the separated fuel to break up and atomize for combustion within the combustion chamber 56.

Atomization quality may depend upon a thickness of the film of fuel as well as a velocity and swirl of the air from the inner and the outer passages 84 and 86. The thickness of the film of fuel may depend upon an amount of fuel injected by the nozzle orifices 158 onto the swirler inner wall 82 and a length of travel along the swirler inner wall 82. Therefore, in general, decreasing the length of travel of the film of fuel along the swirler inner wall 82 may result in a thinner film thickness. Thus, the distal inner wall end 118 is positioned forward of the distal outer wall end 138 as described above. By providing a thinner film thickness, the fuel injector assembly 60 of the present disclosure may be operable to facilitate improved fuel and air mixing and/or a reduction in combustion dynamics.

Figure 9:
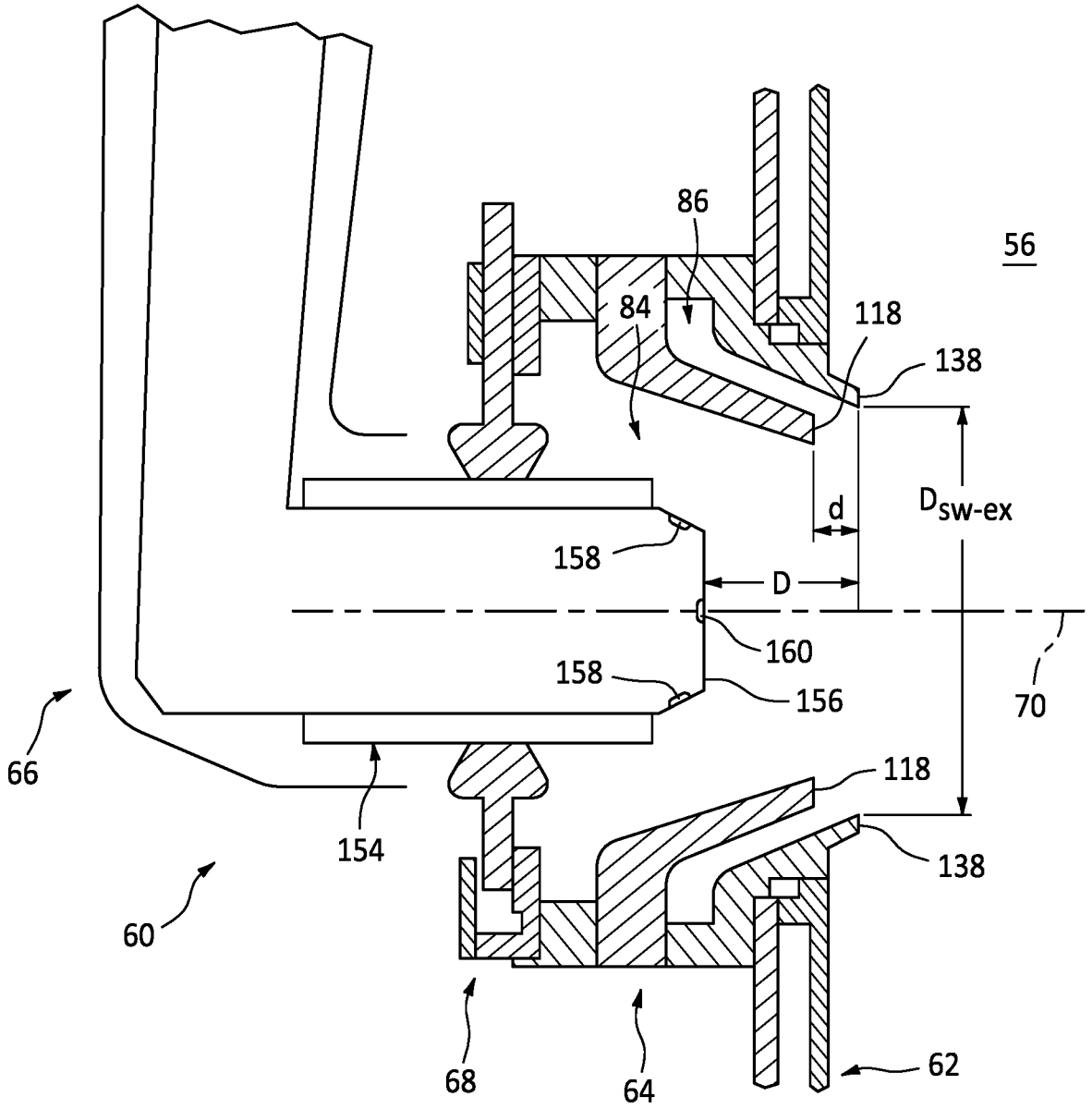
FIG. 9 is another partial side sectional diagrammatic illustration of the swirler mated with the fuel nozzle and the combustor bulkhead.

Referring to FIG. 9, the tip 156 of the fuel injector nozzle 154 is disposed an axial distance (D) along the axis 70 from the distal outer wall end 138. By minimizing the equation $(D-d)/D_{sw\text{-}ex}$, by decreasing the equation $D/D_{sw\text{-}ex}$ and/or by increasing the equation $d/D_{sw\text{-}ex}$, it has been found that combustion tones within the combustion chamber 56 may be reduced. For example, the fuel injector assembly 60 may be configured such that the equation $(D-d)/D_{sw\text{-}ex}$ is less than or equal to one (e.g., less than 0.80) and/or greater than or equal to 0.25 (e.g., greater than 0.30). The fuel injector assembly 60, for example, may be configured such that the equation $(D-d)/D_{sw-ex}$ is between 0.35 and 0.68.

The fuel injector assembly 60 may be configured such that the equation $D/D_{sw-ex}$ is less than or equal to one and/or greater than or equal to 0.40. The fuel injector assembly 60, for example, may be configured such that the equation $D/D_{sw-ex}$ is between 0.50 and 0.75.

The fuel injector assembly 60 may be configured such that the equation $d/D_{sw-ex}$ is less than or equal to 0.20 and/or greater than or equal to 0.05. The fuel injector assembly 60, for example, may be configured such that the equation $d/D_{sw-ex}$ is between 0.07 and 0.15. The swirler 64 is described above with a multi-segment body, where each segment 76-78 may be discretely formed and subsequently connected (e.g., bonded and/or mechanically fastened) to the other segment(s). However, in other embodiments, the swirler 64 may be configured such that any two or all of the segments 76-78 are formed integrally together as a unitary, monolithic body via, for example, casting and/or additive manufacturing.

In some embodiments, the swirler 64 may be configured with two airflow inlets. The swirler 64, for example, may be configured without the upstream swirler segment 76. In still other embodiments, the swirler 64 may be configured with more than three airflow inlets. The fuel injector assembly 60 may be included in various turbine engines other than the one described above as well as in other types of fuel powered equipment. The fuel injector assembly 60, for example, may be included in a geared turbine engine where a gear train connects one or more shafts to one or more rotors in a fan section, a compressor section and/or any other engine section. Alternatively, the fuel injector assembly 60 may be included in a turbine engine configured without a gear train. The fuel injector assembly 60 may be included in a geared or non-geared turbine engine configured with a single spool, with two spools (e.g., see FIG. 1), or with more than two spools. The turbine engine may be configured as a turbofan engine, a turbojet engine, a propfan engine, a pusher fan engine or any other type of turbine engine. The present disclosure therefore is not limited to any particular types or configurations of turbine engines or equipment.

Additional swirler 64 embodiments are shown in FIGS. 10-14 and described below. In these swirler 64 embodiments the intermediate swirler segment 77 and the downstream swirler segment 78 include alternative geometries and thereby provide alternative geometries at the inner nozzle outlet 142 and at the outer nozzle outlet 144. The alternative inner and outer nozzle 142, 244 geometries are not, however, limited to use with a swirler 64 as described with regard to FIGS. 2-9. To facilitate the description of these alternative geometries, however, they will be described herein in terms of a swirler 64 described above with regard to FIGS. 2-9 modified in the manner described hereinafter.

In the alternative geometries the inner passage 84 is formed radially within the swirler segments 77, 78, and is fluidly coupled with the upstream airflow inlet 94 and the intermediate airflow inlet 112, and extends from the airflow inlets 94, 112 to the inner nozzle outlet 142. The swirler outer wall 80 projects out from the downstream swirler segment base 124 and extends axially (in the downstream direction along the axis 70) to an annular distal outer wall end 138. The outer passage 86 is an annular passage formed by the swirler segments 77 and 78. The outer passage 86 is formed radially between the swirler inner wall 82 and the swirler outer wall 80. The outer passage 86 is fluidly coupled with the downstream airflow inlet 132. The outer passage 86 extends from the downstream airflow inlet 132 to the outer nozzle outlet 144. The outer nozzle outlet 144 is defined by and radially between the swirler inner and outer walls 82 and 80 at their distal ends 118 and 138.

Figure 10:
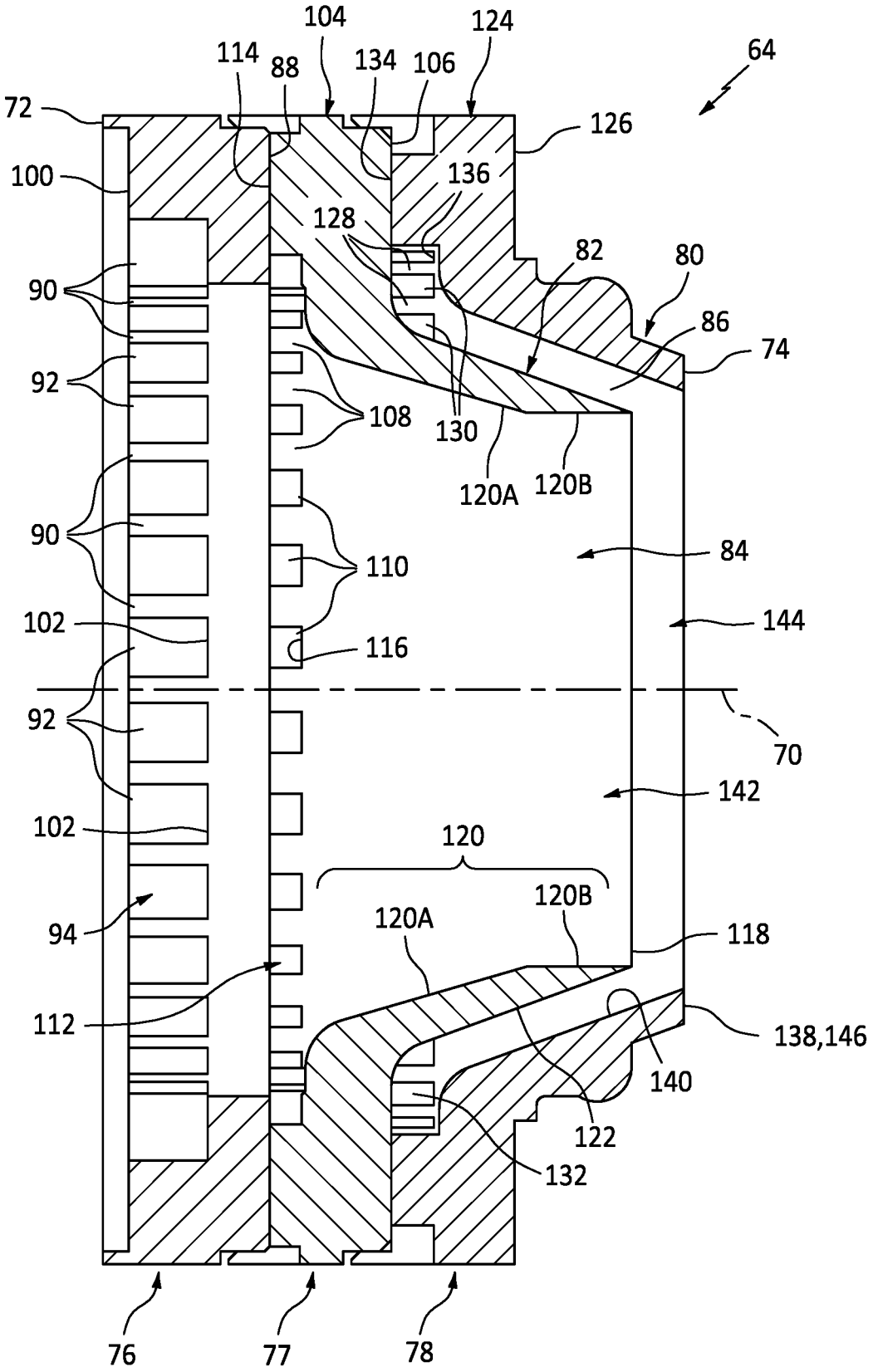
FIG. 10 is a side sectional diagrammatic illustration of a swirler embodiment.
Figure 10A:
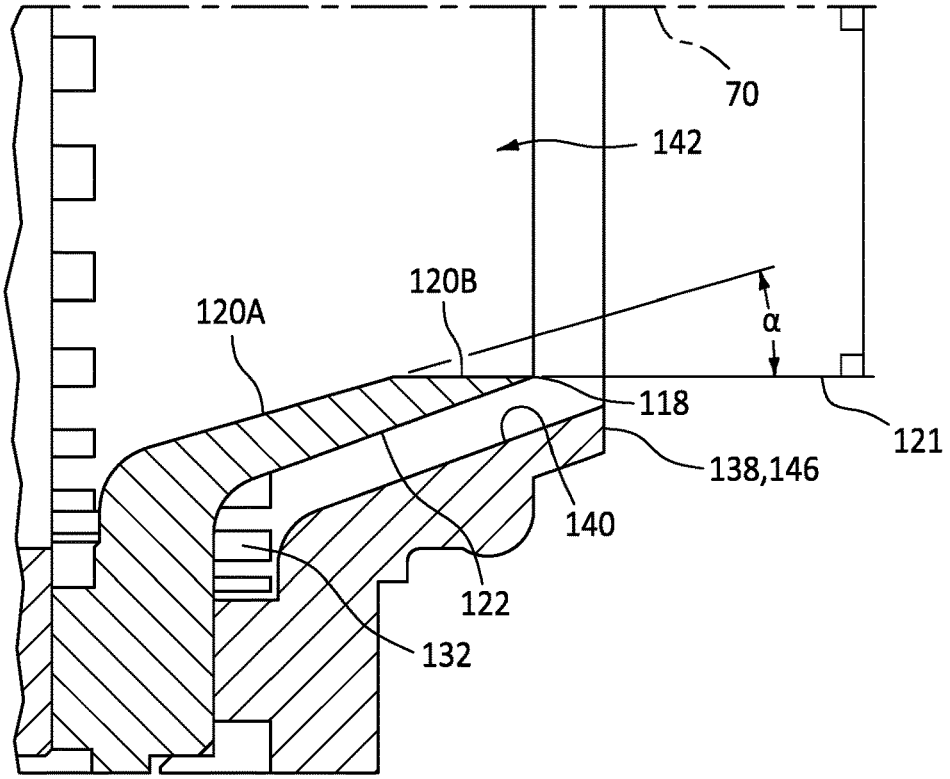
FIG. 10A is an enlarged portion of a side sectional diagrammatic illustration of a swirler embodiment.
Figure 10B:
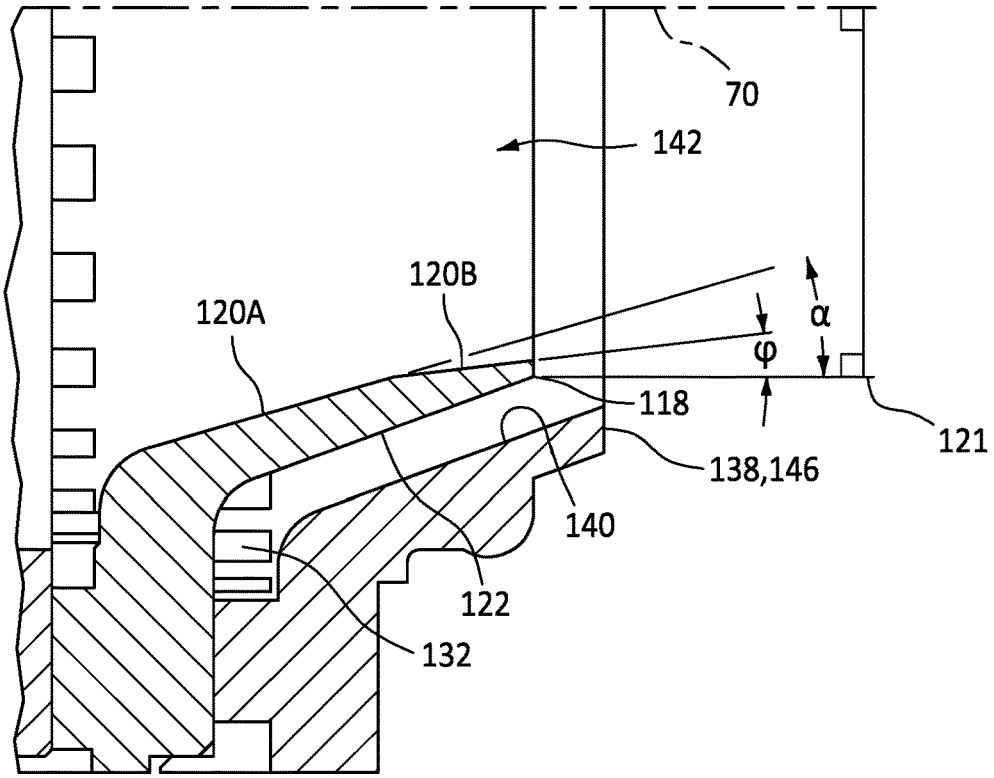
FIG. 10B is an enlarged portion of a side sectional diagrammatic illustration of a swirler embodiment.
Figure 11:
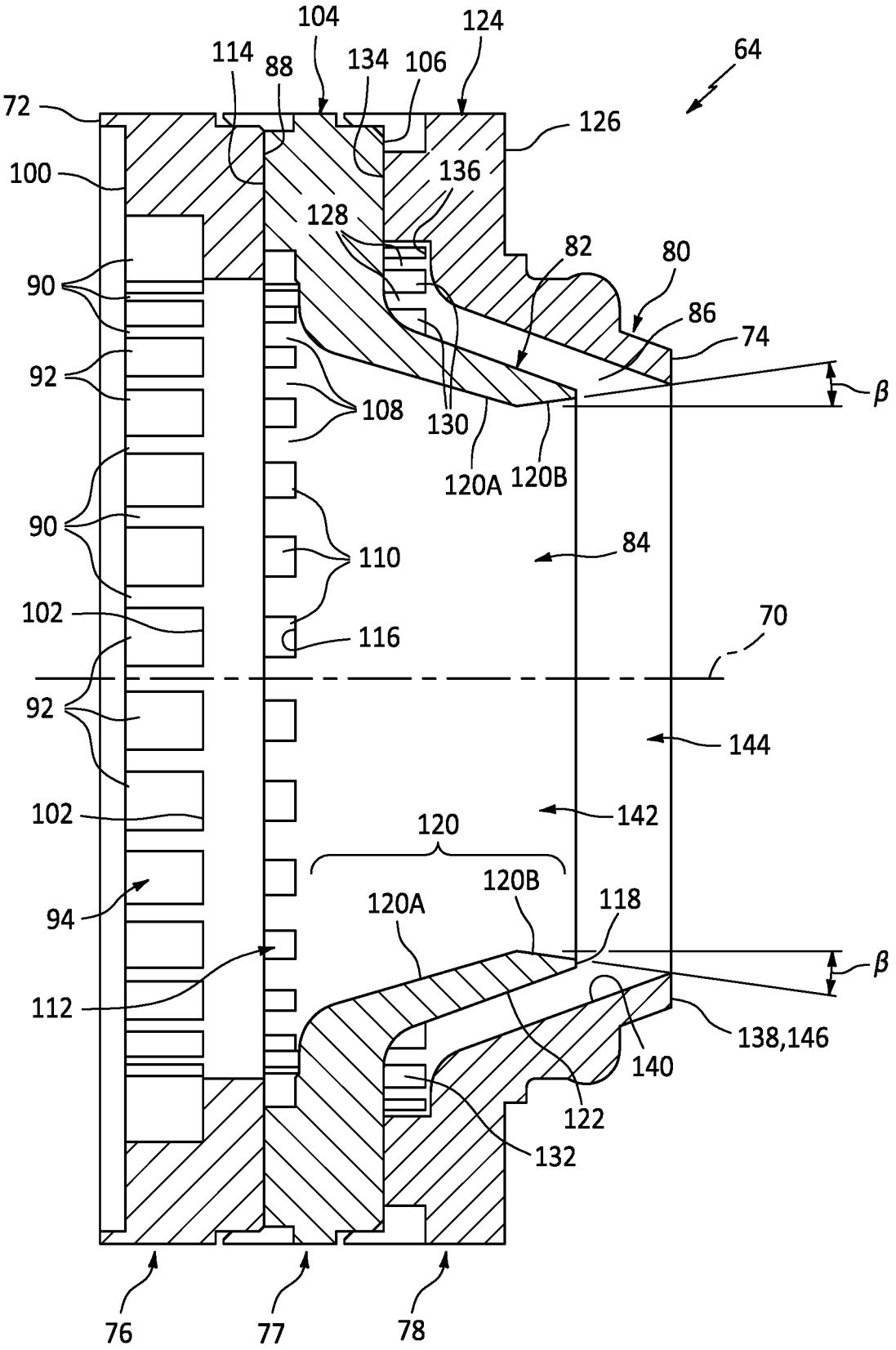
FIG. 11 is a side sectional diagrammatic illustration of a swirler embodiment.
Figure 12:
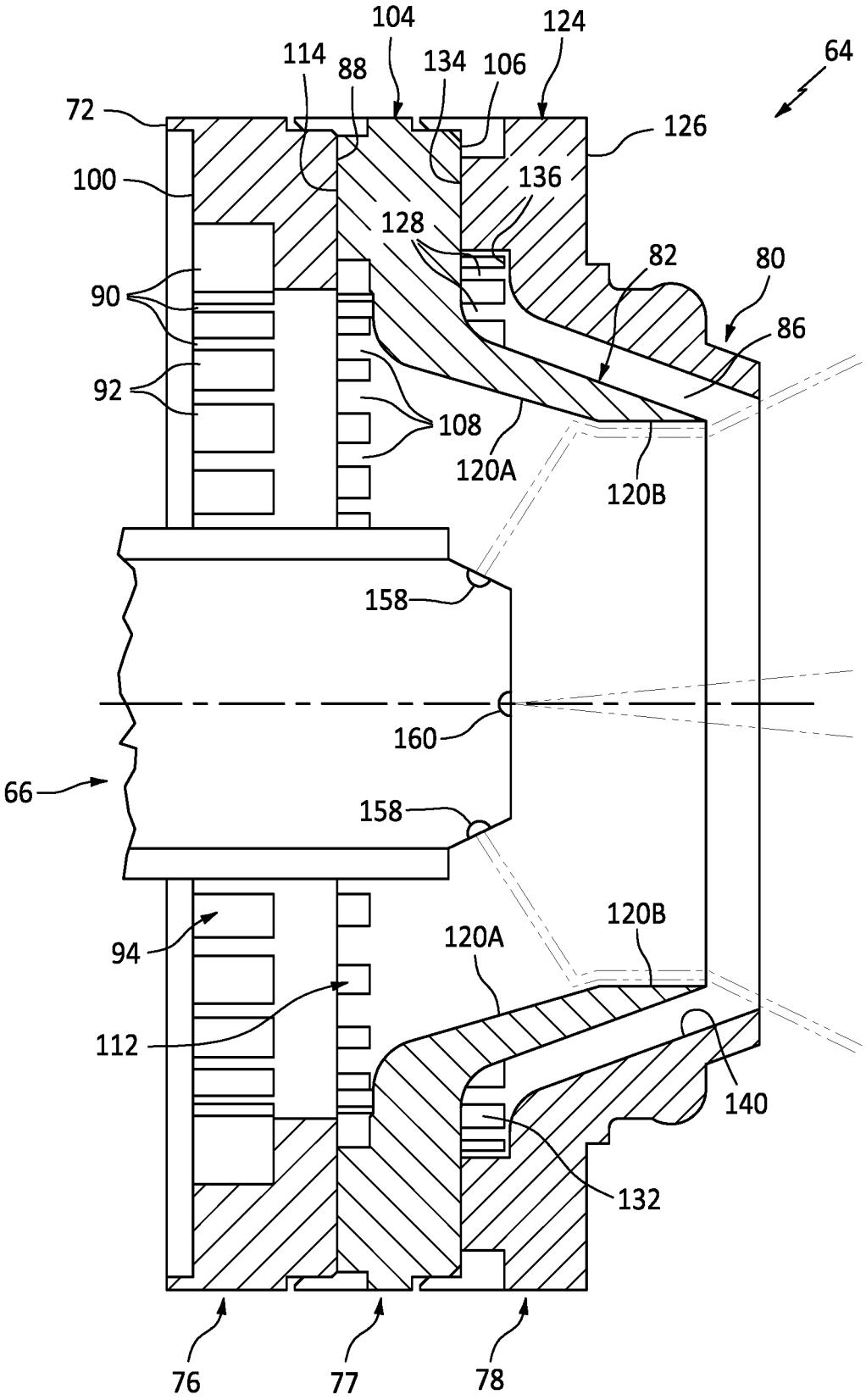
FIG. 12 is a side sectional diagrammatic illustration of a swirler embodiment mated with a fuel nozzle.

In the embodiment shown in FIGS. 10-12, the swirler inner wall 82 has a swirler inner wall (SIW) inner surface 120 that includes a first section 120A and a second section 120B. The second section 120B extends from the distal inner wall end 118 to the first section 120A. The first section 120A extends from the intermediate airflow inlet 112 to the second section 120B in a conical configuration; i.e., tapers radially inward towards the axis 70 at an angle alpha ("α"—see FIG. 10A). The second section 120B extends from the first section 120A at an angle that differs from that of first section 120A. For example, in the embodiment diagrammatically shown in FIGS. 10 and 10A, the second section 120B extends in a direction that is parallel to the axis 70. In the embodiment diagrammatically shown in FIG. 10B, the second section 120B extends in a direction that is tapered radially inward relative to the axis 70, but at an angle phi (i.e., angle "φ") that is less than the angle alpha ("α") of first section 120A; i.e., $\varphi<\alpha$. In the embodiment diagrammatically shown in FIG. 11, the second section 120B extends in a direction that is tapered radially outward at an angle beta C("β") relative to the axis 70. It should be noted that in FIGS. 10A, 10B, and 11, the angles alpha, phi, and beta are illustrated relative to a line 121 that is parallel to the axis 70 for ease of illustration. The intersection of the first section 120A and second section 120B may be defined as the point where the inward radial taper of the first section 120A (i.e., angle α) transitions to a different configuration; i.e., a parallel configuration, a lesser inward radial taper (i.e., φ), or an outward radial taper (i.e., β). The intersection of the first section 120A and second section 120B may be a sharp transition between the two surfaces (e.g., a pointed transition) or may be a smoothed transition (e.g., an arcuate transition) between the two surfaces.

In the radially outward taper configuration shown FIG. 11, the second section 120B may be oriented so that a line contiguous with the surface of the second section 120B is tangential to the inner edge of the distal outer wall end 138. In preferred embodiments, the second section 120B tapers radially outward relative to the axis 70 at the angle beta ((3) relative to axis 70, where beta is in the range of greater than zero degrees and the angle at which the line contiguous with the second section 120B is tangential to the inner edge of the distal outer wall end 138. In the embodiments shown in FIGS. 10-12, the inner wall surface 140 of the outer wall 80 tapers radially inward toward the axis 70 to form a conical configuration. Also in the embodiments shown in FIGS. 10-12, the outer surface 122 of the swirler inner wall 82 and the inner wall surface 140 of the swirler outer wall 80 define an outer passage 86 that may be conically shaped; e.g., the outer surface 122 and the inner wall surface 140 may extend substantially parallel to one another for at least a portion of the outer passage 86.

Like the embodiments shown in FIGS. 2-9, the swirler 64 embodiments shown in FIGS. 10-12 are configured such that the distal inner wall end 118 and the distal outer wall end 138 are axially offset from one another along the axis 70. The distal inner wall end 118, for example, is axially recessed into the swirler 64 from the distal outer wall end 138 an axial distance and the distal outer wall end 138 may thereby define a downstream most surface of the swirler 64.

The swirler nozzle configurations shown in FIGS. 10-12 with a SIW inner wall surface 120 having a second section 120B that is parallel to, or that tapers radially away from the axis 70, promotes a positional shift in the fuel being introduced by the swirler 64. Specifically, a greater percentage of the fuel injected within the swirler 64 is disposed radially outward of the axis 70 downstream of the swirler 64 and into the outer shear layer developed downstream of the swirler 64 and less of the fuel injected within the swirler 64 is disposed radially inward (closer to the axis 70) downstream of the swirler 64 and into the inner shear layer developed downstream of the swirler 64. FIG. 12 diagrammatically illustrates fuel being injected. It is understood that the ability of these present disclosure embodiments to dispose more fuel radially outward in the outer shear layer facilitates entrainment of the fuel. As a result, flame holding is improved and acoustic tones associated with poor flame holding are diminished relative to those produced by conventional swirlers. The parallel or radially outward taper also mitigates sudden gas/fuel mixture volumetric expansion aft of the axial downstream end plane of the swirler and promotes more streamlined fluid low exiting the swirler 64.

Figure 13:
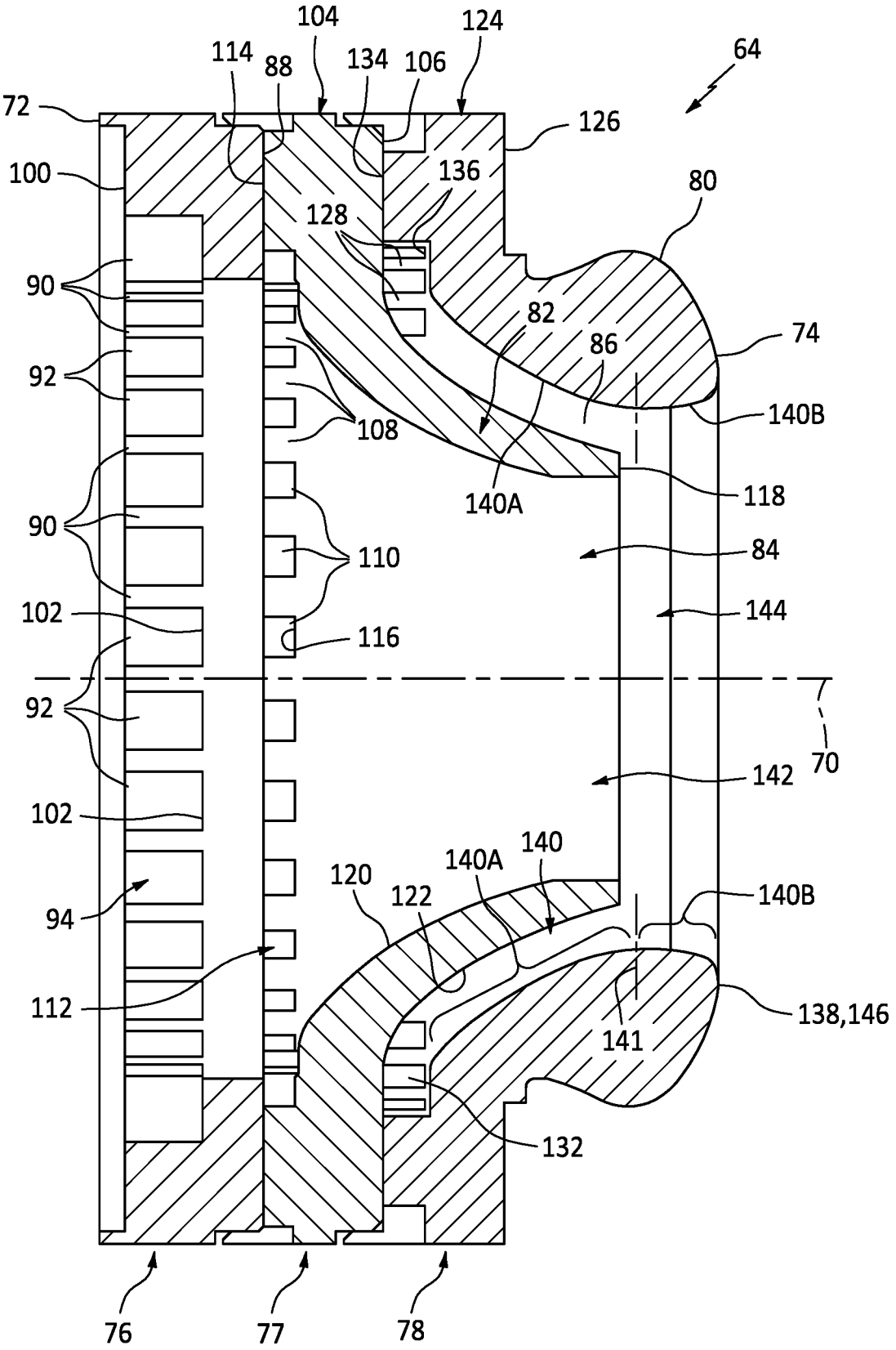
FIG. 13 is a side sectional diagrammatic illustration of a swirler embodiment.
Figure 14:
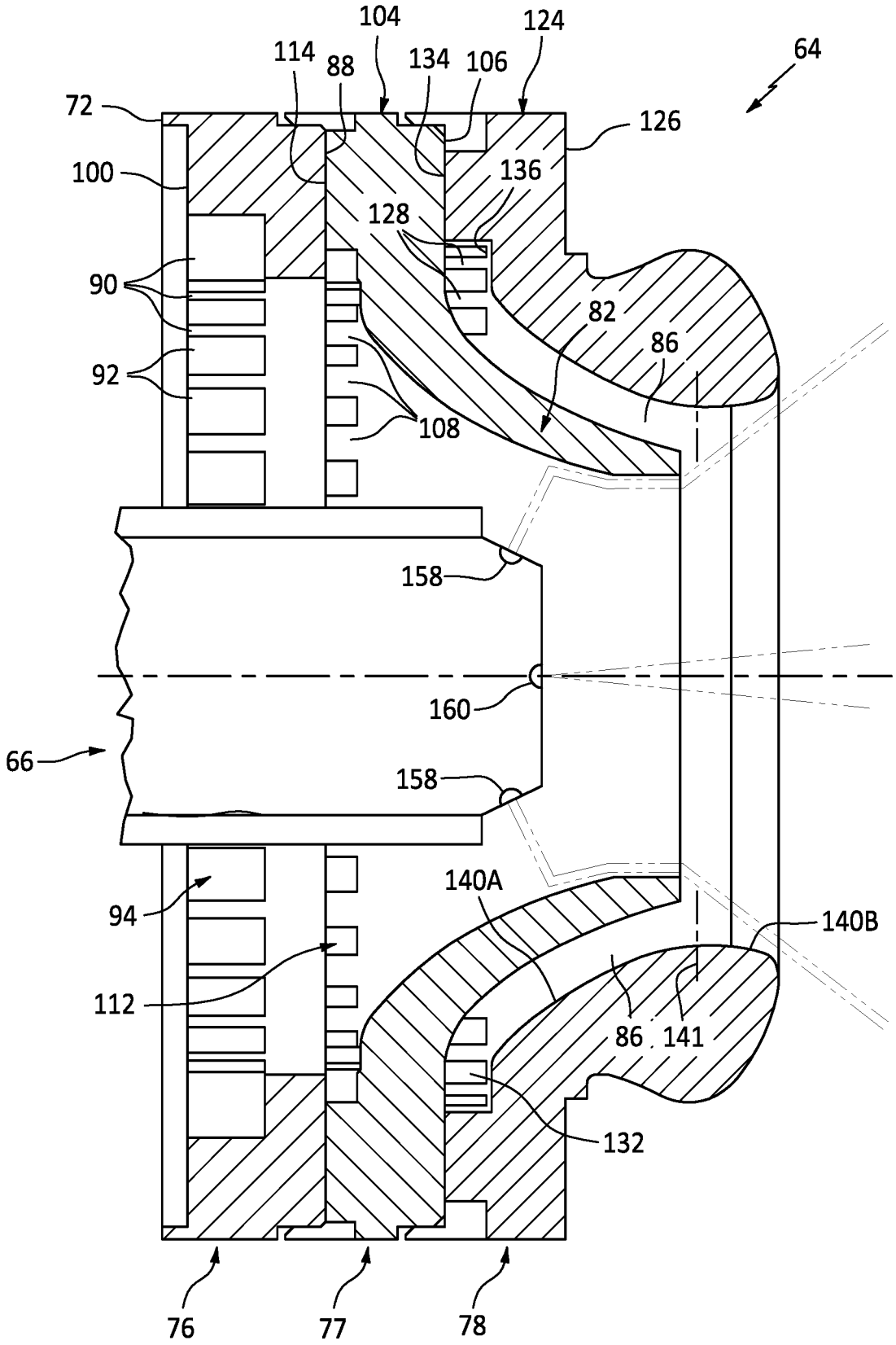
FIG. 14 is a side sectional diagrammatic illustration of a swirler embodiment mated with a fuel nozzle.

In the embodiment shown in FIGS. 13 and 14, the swirler outer wall 80 has a swirler outer wall (SOW) inner surface 140 that is arcuately shaped that includes a first section 140A and a second section 140B. The second section 140B extends from the distal outer wall end 138 to the first section 140A. The first section 140A extends from the downstream airflow inlet 132 to the second section 140B in an arcuate configuration that curves radially inward towards the axis 70. The second section 140B extends from the first section 140A in an arcuate configuration that curves radially away from the axis 70. The intersection of the first section 140A and second section 140B may be defined as the inflection point 141 where the inward radial arcuate taper of the first section 140A transitions to the outward radial arcuate taper of the second section 140B. In the embodiment shown in FIGS. 13 and 14, the outer surface 122 of the swirler inner wall 82 may be arcuately shaped. The arcuately shaped outer surface 122 of the swirler inner wall 82 and the arcuately shaped inner wall surface 140 of the swirler outer wall 80 therefore define an outer passage 86 that is arcuately shaped; e.g., the outer surface 122 and the inner wall surface 140 may extend a distance of the outer passage 86 at a constant distance relative to one another for a length of the outer passage 86.

Like the embodiments shown in FIGS. 2-9, the swirler 64 embodiment shown in FIGS. 13 and 14 is configured such that the distal inner wall end 118 and the distal outer wall end 138 are axially offset from one another along the axis 70. The distal inner wall end 118, for example, is axially recessed into the swirler 64 from the distal outer wall end 138 an axial distance and the distal outer wall end 138 may thereby define a downstream most surface of the swirler 64.

The swirler nozzle configuration shown in FIGS. 13 and 14 with a SOW inner wall surface 140 having a second section 140B of the SOW inner wall 140 that curves radially away from the axis 70 also promotes a positional shift in the fuel being introduced by the swirler 64. Specifically, a greater percentage of the fuel injected within the swirler 64 is disposed radially outward of the axis 70 downstream of the swirler 64 and into the outer shear layer developed downstream of the swirler 64 and less of the fuel injected within the swirler 64 is disposed radially inward (closer to the axis 70) downstream of the swirler 64 and into the inner shear layer developed downstream of the swirler 64. FIG. 14 diagrammatically illustrates fuel being injected. It is understood that the ability of this embodiments of the present disclosure to dispose more fuel radially outward in the outer shear layer facilitates this fuel becoming entrained therein. As a result, flame holding is improved and acoustic tones associated with poor flame holding are diminished relative to those produced by conventional swirlers. The outward radial curvature of the SOW inner wall second section 140B radially away from the axis 70 mitigates sudden volume expansion aft of the axial downstream end plane of the swirler 64 and promotes more streamlined fluid low exiting the swirler 64.

The embodiments shown in FIGS. 10-14 and described above may include the nozzle tip/distal outer wall end 138 axial spacing configurations shown in FIG. 9 and described above; e.g., involving axial distance (D), distance (d) between distal outer wall end 138 and distal inner wall end 118, inner diameter ($D_{sw\text{-}ex}$) at the distal outer wall end 138, and so on.

While the principles of the disclosure have been described above in connection with specific apparatuses and methods, it is to be clearly understood that this description is made only by way of example and not as limitation on the scope of the disclosure. Specific details are given in the above description to provide a thorough understanding of the embodiments. However, it is understood that the embodiments may be practiced without these specific details.

It is noted that the embodiments may be described as a process which is depicted as a flowchart, a flow diagram, a block diagram, etc. Although any one of these structures may describe the operations as a sequential process, many of the operations can be performed in parallel or concurrently. In addition, the order of the operations may be rearranged. A process may correspond to a method, a function, a procedure, a subroutine, a subprogram, etc.

The singular forms "a," "an," and "the" refer to one or more than one, unless the context clearly dictates otherwise. For example, the term "comprising a specimen" includes single or plural specimens and is considered equivalent to the phrase "comprising at least one specimen." The term "or" refers to a single element of stated alternative elements or a combination of two or more elements unless the context clearly indicates otherwise. As used herein, "comprises" means "includes." Thus, "comprising A or B," means "including A or B, or A and B," without excluding additional elements.

It is noted that various connections are set forth between elements in the present description and drawings (the contents of which are included in this disclosure by way of reference). It is noted that these connections are general and, unless specified otherwise, may be direct or indirect and that this specification is not intended to be limiting in this respect. Any reference to attached, fixed, connected or the like may include permanent, removable, temporary, partial, full and/or any other possible attachment option.

No element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprise", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein. For example, in the exemplary embodiments described above within the Detailed Description portion of the present specification, elements may be described as individual units and shown as independent of one another to facilitate the description. In alternative embodiments, such elements may be configured as combined elements. It is further noted that various method or process steps for embodiments of the present disclosure are described herein. The description may present method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the description should not be construed as a limitation.

The invention claimed is:

1. A fuel injector assembly for a gas turbine engine, comprising:

a swirler configured with an outer wall having a swirler outer wall (SOW) inner wall surface, and an inner wall having a swirler inner wall (SIW) inner wall surface and a SIW outer wall surface, an outer passage defined at least in part by the SIW outer wall surface and the SOW inner wall surface, and an inner passage defined in part by the SIW inner wall surface;

wherein the outer wall and the inner wall having a center axis;

wherein the SIW inner wall surface includes a first section and a second section, and the first section extends between a first airflow inlet and the second section, and the second section extends between the first section and a distal end wall of the inner wall, wherein the first section tapers radially inward toward the center axis in a conical configuration at a first angle relative to the center axis, and all of the second section extends at a second angle relative to the center axis, wherein the first angle is different than the second angle, and the second section tapers radially inward at the second angle toward the center axis in a conical configuration relative to the center axis;

wherein the outer wall circumscribes the inner wall and extends axially along the center axis to a distal outer wall end, and the distal end wall of the inner wall is axially recessed within the swirler from the distal outer wall end; and a fuel nozzle projecting into the inner passage.

2. The fuel injector assembly of claim 1, wherein the SOW inner wall surface tapers radially inward toward the center axis in a conical configuration.

3. The fuel injector assembly of claim 2, wherein at least a portion of the SOW inner wall surface is parallel at least a portion of the SIW outer wall surface.

4. The fuel injector assembly of claim 2, wherein the distal outer wall end is disposed a first distance along the center axis from a tip of the fuel nozzle, and the distal outer wall end is disposed a second distance along the center axis from an end of the distal end wall of the inner wall, and the outer passage has a diameter at the distal outer wall end, and a first value is equal to the first distance minus the second distance, and wherein a quotient of the first value divided by the diameter is less than one.

5. The fuel injector assembly of claim 1, wherein the first section of the SIW inner wall surface intersects with the second section of the SIW inner wall surface.

6. The fuel injector assembly of claim 1, wherein the inner wall includes an arcuate transition between the first section of the SIW inner wall surface and the second section of the SIW inner wall surface.

7. A fuel injector assembly for a gas turbine engine, comprising:

a swirler configured with an outer wall having a swirler outer wall (SOW) inner wall surface, and an inner wall having a swirler inner wall (SIW) inner wall surface and a SIW outer wall surface, an outer passage defined at least in part by the SIW outer wall surface and the SOW inner wall surface, and an inner passage defined in part by the SIW inner wall surface;

wherein the outer wall and the inner wall having a center axis;

wherein the SIW inner wall surface includes a first section and a second section, and the first section extends between a first airflow inlet and the second section, and the second section extends between the first section and a distal end wall of the inner wall, wherein the first section tapers radially inward toward the center axis in a conical configuration at a first angle relative to the center axis, and the second section tapers radially away from the center axis;

wherein the outer wall circumscribes the inner wall and extends axially along the center axis to a distal outer wall end, and the distal end wall of the inner wall is axially recessed within the swirler from the distal outer wall end; and a fuel nozzle projecting into the inner passage; and wherein the second section is disposed at an angle beta relative to the center axis, wherein the angle beta is in the range of greater than zero degrees and an angle at which a line contiguous with the second section is tangential to an inner edge of the distal outer wall end.

8. The fuel injector assembly of claim 7, wherein the second section is conically configured.

* * * * *